United States Patent [19]

Hodges

[11] Patent Number: 4,642,824

[45] Date of Patent: Feb. 17, 1987

[54] BED ACCESS APPARATUS FOR INVALIDS AND HANDICAPPED

[76] Inventor: Ronald R. Hodges, 5577 Kenowa, Grandville, Mich. 49418

[21] Appl. No.: 781,260

[22] Filed: Sep. 27, 1985

[51] Int. Cl.[4] ..... A61G 7/08

[52] U.S. Cl. ..... 5/81 R; 5/200 R; 5/445

[58] Field of Search ..... 5/81 R, 81 C, 81 B, 5/82 R, 82 B, 83–89, 200 R, 200 C, 201, 202, 285, 424, 425, 427–430, 445, 503, 505, 507, 509, 510; 248/298

[56] References Cited

U.S. PATENT DOCUMENTS

| | | | |
|---|---|---|---|
| 319,283 | 6/1885 | Marsh | 5/85 |
| 697,687 | 4/1902 | Sprague | 248/298 |
| 1,021,930 | 4/1912 | Jackson | 5/414 |
| 1,082,177 | 12/1913 | Skeffington | 5/88 |
| 1,292,075 | 1/1919 | Augustine | 5/85 |
| 1,505,437 | 8/1924 | Schweizer | 5/85 |
| 1,698,754 | 1/1929 | Godbois | 5/445 |
| 1,699,026 | 1/1929 | Schumacher et al. | 5/82 R |
| 2,079,617 | 5/1937 | Johnson | 5/445 |
| 2,259,757 | 10/1941 | Longfellow | 5/445 |
| 2,272,778 | 2/1942 | Reuter | 5/85 |
| 2,368,390 | 1/1945 | Winter | 5/86 |
| 2,603,851 | 7/1952 | Hawkins | 27/28 |
| 2,745,117 | 5/1956 | Sands | 5/200 R |
| 2,830,303 | 4/1958 | Sandock | 5/63 |
| 3,247,528 | 4/1966 | Swenson et al. | 5/509 |
| 3,310,817 | 3/1967 | Harding | 5/445 |
| 3,612,042 | 10/1971 | Fry | 5/81 B |
| 3,850,165 | 11/1974 | Throner | 128/84 C |
| 3,967,334 | 7/1976 | Ricke et al. | 5/505 |
| 3,984,884 | 10/1976 | Spitz | 5/201 |
| 4,375,707 | 3/1983 | Boerigter | 5/81 R |

OTHER PUBLICATIONS

Excerpt from brochure showing Invacare Company Mobilaid brand patient care products, 7030 basic frame stucture; a sketch of an overhead bar assembly observed at St. Mary's Hospital in Rochester, Minn.

*Primary Examiner*—John E. Murtagh
*Assistant Examiner*—Andrew Joseph Rudy
*Attorney, Agent, or Firm*—Price, Heneveld, Cooper, DeWitt & Litton

[57] ABSTRACT

A bed access apparatus for use with a wide variety of bed designs, that includes a structural framework having floor anchor plates that rest upon the supporting floor surface. The bed rests on top of the anchor plates so that the apparatus is stabilized by the bed. An outrigger bar extends generally laterally to overhead connecting bars that extend the length of the bed, and the outrigger bar is spaced above the overhead bars in order to provide a raised handhold that extends out over the side of the bed.

21 Claims, 9 Drawing Figures

BED ACCESS APPARATUS FOR INVALIDS AND HANDICAPPED

BACKGROUND OF THE INVENTION

The present invention relates to health care articles and in particular to apparatus used by patients for transfer into and out of bed.

A wide variety of bed mounted frameworks have previously been used as traction support frames on hospital beds, and as devices for transferring patients into and out of bed. However, even though a wide variety of designs for such apparatus have been developed, these apparatus are typically designed for hospital or institutional use and therefore are adapted to be used only with a hospital-type bed. Such structures must be secured to the bed frame in some fashion in order to utilize the frame itself as a supporting base. Typically, these apparatus include one or two horizontal bars that extend the length of the bed and are spaced above the mattress. These horizontal bars join with vertical posts that are either bolted to the headboard and footboard, or may be clamped or bolted onto the legs of the bed. As will be recognized, such attachments require that a particular style of bed frame be provided, and normally a hospital-type bed with a tubular frame.

Most existing apparatus are therefore limited in the type or design of bed that the apparatus can be used with. Such conventional apparatus normally cannot be used with a typical household bed, which prevents the patient from using his or her own bed even after the patient has left the hospital.

As previously noted, most conventional bed access or exercise apparatus include one or two horizontal bars that extend the length of the bed and are secured both at the head and foot ends of the bed. These overhead bars provide the patient with a handhold in order to shift himself toward the side of the bed, or may be used to perform various exercises while lying on the bed. To assist in the exercise function many other accessories can be secured to the overhead bars, such as a trapeze, straps or the like that provide a handhold that is easier for the patient to reach.

Such apparatus are generally satisfactory for exercise, traction and the like while the patient is on the bed. However, since the overhead bars are normally centered over the bed and spaced away from the bedside, these apparatus often do not provide sufficient assistance to the patient for getting into or out of the bed. This is particularly the case, for example, when a patient is wearing a cast or the like that immobilizes both the hip and knee joints. Although the person can draw himself to the edge of the bed and swing his feet to the floor, no firm handhold is provided to allow the patient to pull himself upright to a standing position. The same is true for the reverse operation of getting into the bed.

Although some previous bed access devices have used an overhead cantilevered beam or the like that extends laterally to the overhead bars, such beams have normally been used as a track for mechanical lifting devices. These devices actually hoist the patient out of the bed and carry the patient to the bedside. Such devices have not provided an overhead bar that the patient can use himself in order to get into and out of bed. Further, since such devices provide a mechanical guide track that extends at the same height as the overhead bars, the lateral guide track is generally too low to provide a handhold alongside the bed which does not obstruct walking around the bed or the locating of a wheelchair alongside. If the lateral guide track is high enough so as to not obstruct the side of the bed, the bar would be too high to be reached by a person while lying on the bed.

For these reasons, many patients have been forced to rely upon either a mechanical device or another person to assist them into and out of bed, which often adds to the confined or dependent feelings they may be already experiencing due to their condition.

SUMMARY OF THE INVENTION

The present invention solves the problems noted above by the provision of a bed access apparatus that can be adapted to a wide variety of beds, whether residential or hospital-type. The apparatus provides a passive structure that the patient can use to move himself into and out of bed without requiring mechanical assistance. In one embodiment, the apparatus includes a framework having floor anchor plates secured to the framework base. The bed is seated on these anchor plates so that the structure utilizes the weight of the bed itself as a stabilizing force, even though the structure is not clamped, bolted or otherwise secured directly to the bed.

In another embodiment the bed provides at least one overhead bar that extends along the length of the bed at a height that is accessible to a person lying on the bed. An outrigger bar extends generally laterally to the overhead bar in order to extend out over the bedside. The outrigger bar is raised above the overhead bar in order to provide a handhold for a person standing or seated in a wheelchair alongside the bed. Since the outrigger bar is raised people are permitted to walk beneath the bar and the bedside is therefore not obstructed. Since the apparatus is a freestanding structure, the apparatus is adapted to use with a wide variety of beds.

The present invention provides an apparatus that can be used both in an institutional and home setting. A patient can thus use his own bed in order to provide more comfortable surroundings. Further, the apparatus permits the patient to transfer himself into and out of bed without mechanical assistance and often without assistance from another person. The structure is not generally institutional in appearance and therefore does not detract from a residential environment to the degree of other such devices. Also, the structure breaks down into generally flat modules for transportation and storage.

DETAILED DESCRIPTION OF THE PREFERRED EMBODIMENTS

Figure 1:
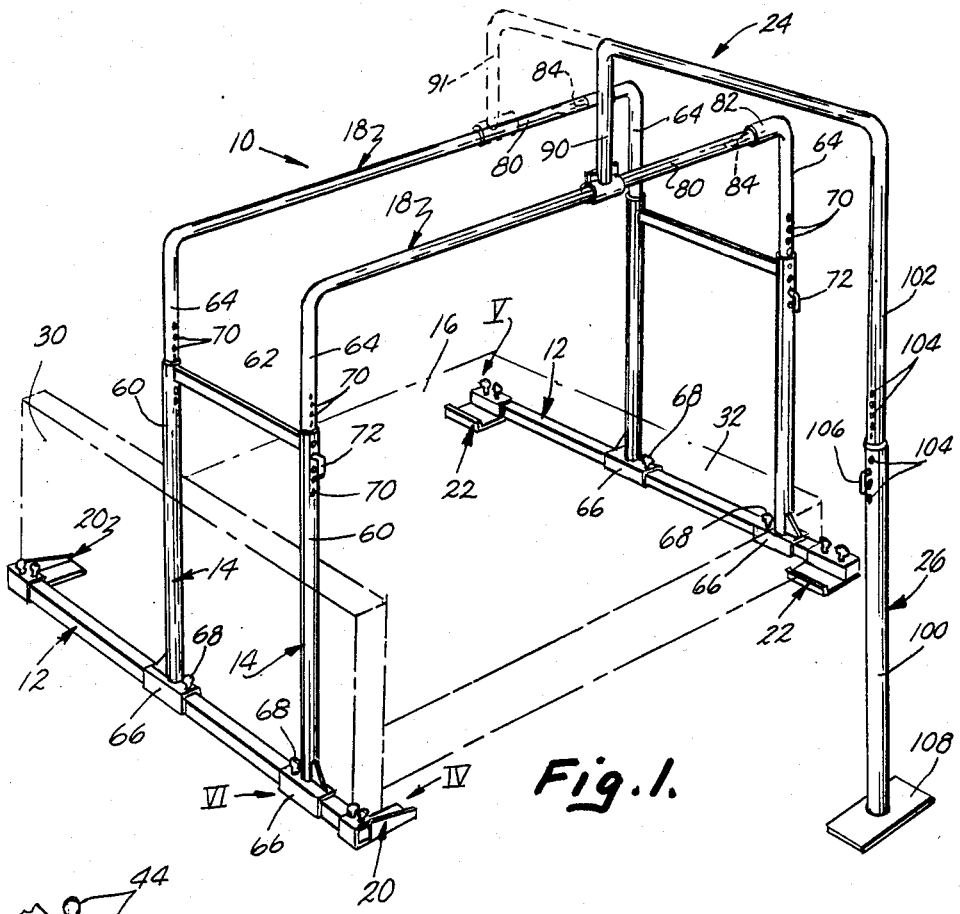
FIG. 1 is a perspective view of an apparatus embodying the invention.

A first preferred embodiment of the bed access apparatus is shown in FIG. 1 and referenced generally by the numeral 10. The apparatus includes a pair of spaced base or floor runners 12, from which extend a set of generally vertical uprights 14 at both ends of a bed 16. Corresponding uprights 16 are joined by a pair of parallel overhead bars 18 that extend the length of bed 16. A pair of head anchor plates 20 are coupled to one base runner 12 so as to be slidably adjustable along its length, while another pair of foot anchor plates 22 are coupled to the opposite base runner 12 so as to be slidably adjustable along its length. Bed 16 rests upon anchor plates 20 and 22 so as to stabilize apparatus 10, without being otherwise directly connected thereto. An outrigger bar 24 is coupled to one overhead bar 18 so as to extend generally horizontally and laterally thereto. At the outboard end of outrigger bar 24 is an outrigger support post 26 that rests upon the floor surface so that apparatus 10 is a free standing unit. Outrigger bar 24 is spaced above overhead bars 18 and thereby provides a raised handhold alongside bed 16.

As shown in FIG. 1, base runners 12 are hollow rectangular tubes, preferably 58 inches long, that extend along the supporting floor surface. One base runner 12 extends along the head end 30 of bed 16 while the other floor runner 12 extends along foot 32 of bed 16. Floor runners 12 are spaced sufficiently to accommodate a full size bed therebetween.

Figure 4:
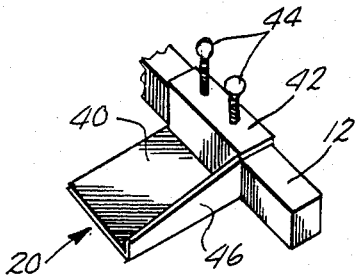
FIG. 4 is a fragmentary, perspective view of the support base for the apparatus taken at Arrow IV of FIG. 1.

Shown in greater detail in FIG. 4 is one head anchor plate 20. The other head anchor plate 20 is a mirror image thereof. Head anchor plate 20 includes a flat plate or platform 40 that extends from runner 12 towards bed 16 along the supporting floor surface. Platform 40 extends from a short rectangular collar 42 that is slidably received over base runner 12. Collar 42 slides along the length of floor runner 12 so as to adjust the spacing of head anchor plates 20 to correspond to the particular width of bed 16. A pair of hand tightened clamp bolts 44 protrude through the upper surface of collar 40. Bolts 44 lock collar 42 in place on floor runner 12.

When floor anchor plate 20 is positioned on rail 12, the support leg for bed 16 rests on top of platform 40 in order to provide a stable base for apparatus 10. A sidewall or lip 46 protrudes upwardly along the outer side of platform 40 in order to abut the supporting leg of the bed 16. Sidewalls 46 of head anchor plates 20 cooperate to prevent floor runner 20 from shifting sideways and thus prevent head anchor plates 20 from sliding out from beneath of the legs of bed 16.

Figure 5:
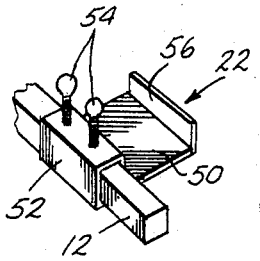
FIG. 5 is a fragmentary, perspective view of the support base for the apparatus taken at Arrow V of FIG. 1.
Figure 2:
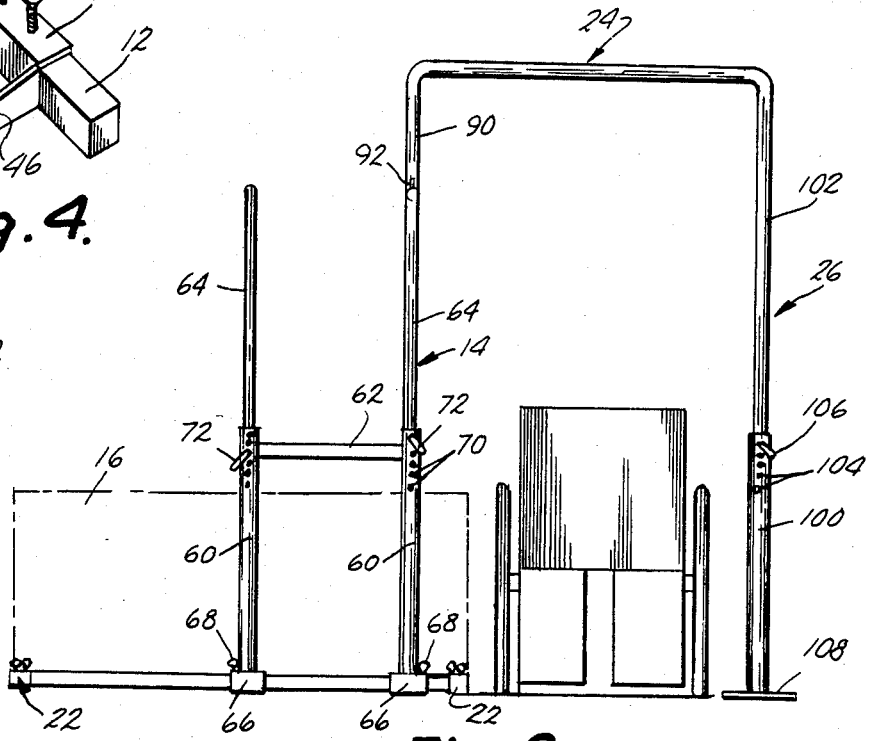
FIG. 2 is a headboard end, elevational view of the apparatus of FIG. 1, shown with a wheelchair alongside a bed used with the apparatus.
Figure 3:
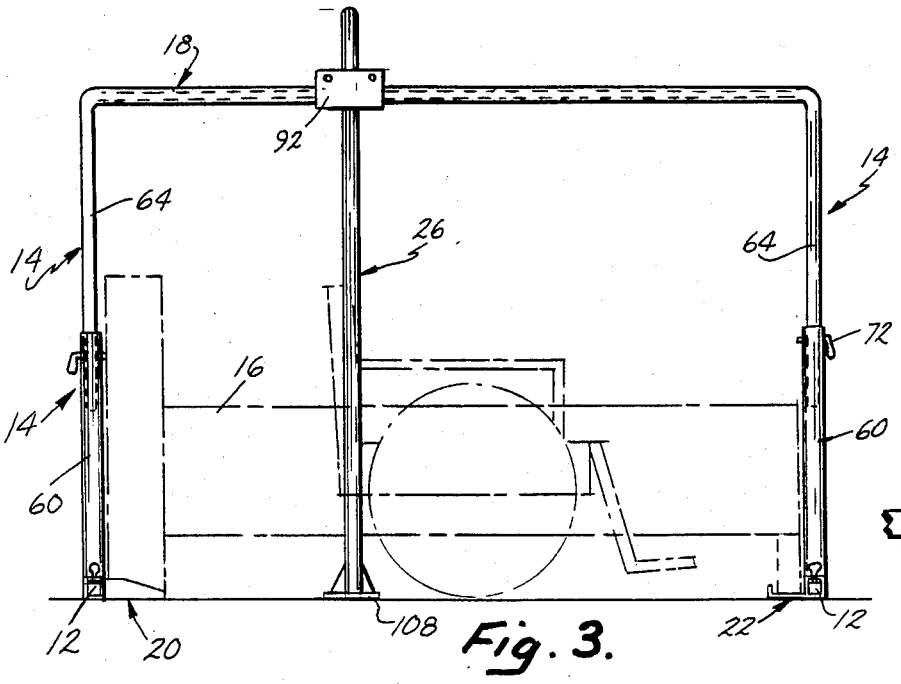
FIG. 3 is a side elevational view of the apparatus of FIG. 1.

One foot anchor plate 22 is shown in greater detail in FIG. 5. The other foot anchor plate 22 is identical thereto. Foot anchor plate 22 is similar to head anchor plate 20, in that foot anchor plate 22 includes a floor platform 50 that extends along the floor surface toward bed 16 from a collar 52. Collar 52 is slidably received over base runner 12. A pair of clamp bolts 54 are threaded through collar 52 in order to lock foot anchor plate 20 in the selected position along the length of base runner 12. Anchor plates 22 differ from anchor plates 20 in the provision of an end wall or lip 56 that protrudes upwardly from floor platform 50 parallel to base runner 12. End walls 56 are positioned adjacent the support legs for bed 16 and also assist in preventing the support legs from sliding off of foot anchor plates 22.

Uprights 14 for each end of bed 16 include a pair of spaced lower sections 60 joined by a crossbar 62 that is welded between the upper ends of sections 60 to form a unit. An upper section 64 is telescopingly received in each lower section 60. Connecting bars 18 span between corresponding upper sections 64 at the head and foot of apparatus 10, in order to provide a pair of parallel overhead bars that extend the length of bed 16.

Figure 6:
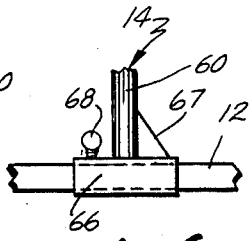
FIG. 6 is a fragmentary, end elevational view of the support base for the device showing a connector for an upright taken at Arrow VI of FIG. 1.

Lower sections 60 of uprights 14 are each welded to a rectangular collar 66 (FIG. 6), and the joint is reinforced by a gusset 67. Collars 66 are slidingly received over base runners 12 in order to be slidably adjustable along the length of runners 12. A hand tightened clamping bolt 68 is threaded through the upper surface of each collar 66 in order to provide a locking or clamping adjustment between collar 66 and runner 12. Uprights 14 may therefore be slid along the length of runners 12 between anchor plates 20 and 22.

Lower sections 60 and upper sections 64 of each upright 14 include complementary vertical adjustment apertures 70 that align to receive a vertical adjustment pin 72. The height of upright 14 can thus be adjusted in order to accommodate beds 16 of different heights and also to accommodate different armlengths of patients using apparatus 10. Uprights 14 preferably have an overall height of 58 inches, with a 7 inch telescoping overlap between lower sections 60 and upper sections 64. The relative height of lower section 60 to upper section 64 may be varied, but is preferable that lower section 60 have a greater height in order to position crosspiece 62 toward the upper end of uprights 14 for greater stability.

As shown in FIG. 1, overhead bars 18 are generally horizontal, tubular bars. Overhead bars 18 each include two sections 80 and 82 that permit the use of overhead bars 18 of different lengths. Section 82 includes a smaller diameter adjustment post or bar 84 that projects from one end and is telescopingly received in section 80. A bolt or pin passes through section 80 and adjustment post 84 in order to lock sections 80 and 82 together. Alternatively, section 82 can have a smaller diameter so as to be telescopingly received in section 80, with a bolt or locking pin securing sections 80 and 82 together. Overhead bars 18 of varying lengths can thus be used depending upon the length of bed 16.

Figure 7:
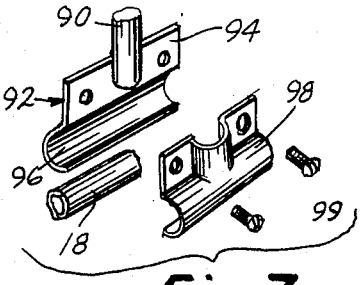
FIG. 7 is an exploded, fragmentary perspective view of the outrigger bar coupling taken at Arrow VII of FIG. 1.

Outrigger bar 24 includes a height spacer bar 90 that extends generally vertically upwardly from one overhead bar 18. At the lower end of spacer bar 90 is a clamp 92 that is shown in FIG. 7 in greater detail. Clamp 92 includes a fixed plate 94 that is welded to spacer bar 90, and includes a semi-circular channel 96 that mates with overhead bar 18. A separable clamp plate 98 is configured similarly to fixed plate 94. Fixed plate 94 and clamp plate 96 are bolted together by bolts 99 in order to clamp over overhead bar 18. Spacer bar 90 is preferably 17 inches high, but other vertical spacings could be provided. Shown in phantom in FIG. 1 is an alternative coupling for outrigger bar 24 to both overhead bars 18. Outrigger bar 24 extends over both overhead bars 18, and another spacer bar 91 extends upwardly from a clamp 92. Outrigger bar 24 can also alternatively angle downwardly to the second overhead bar 18. Outrigger bar 24 is preferably 42 inches long, so as to provide this spacing between support post 26 and overhead bar 18 and permit the positioning of a wheelchair alongside bed 16.

Support post 26 includes a lower section 100 and a telescoping upper section 102. Upper section 102 is connected to the outboard end of outrigger bar 24. Both lower section 100 and upper section 102 have complementary vertical adjustment apertures that align and receive a lock pin 106. The height of support post 26 is therefore adjustable along with the adjustment of uprights 14. At the base of lower section 100 is a base plate or platform 108 that rests upon the supporting floor surface. Support post 26 is preferably 75 inches overall with a seven inch overlap between lower section 100 and upper section 102.

Alternatively, height spacer bar 90 can also have a telescoping height adjustment (not shown) in order to permit the spacing between outrigger bar 24 and overhead bar 18 to be adjusted.

Apparatus 10 can be disassembled for transportation or storage into generally flat modules. For such disassembly, clamp 92 is disconnected so that outrigger 24 and support post 26 form a generally flat module. Overhead bars 18 with upright upper sections 64 attached are removed to also form generally flat modules. When anchor plates 20 and 22 are removed from floor runners 12, upright lower sections 60 and floor runners 12 form a pair of generally flat modules. The various modules can then be stacked and stored in a very compact condition.

In use, a patient can pull himself to a seated position on the bed by grasping parallel bars 18 overhead and shifting himself to the edge of the bed. After his legs are swung down onto the floor the patient can grasp outrigger bar 24 and pull himself fully erect without obstruction from outrigger bar 24. The apparatus can be used in similar fashion by the patient to transfer himself onto a wheelchair positioned between bed 16 and support post 26, with the reverse process being used to get into bed 16. Outrigger bar 24 and overhead bars 18 may also be used for a variety of exercises in addition to assisting the patient in getting into and out of bed.

EMBODIMENT OF FIGS. 8 AND 9

Figure 9:
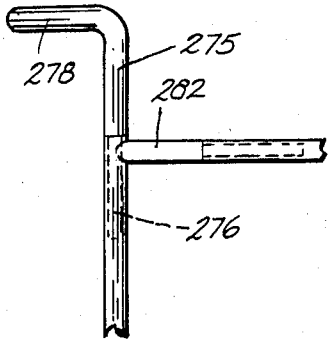
FIG. 9 is a fragmentary, side elevational view taken in region IX of FIG. 8.
Figure 8:
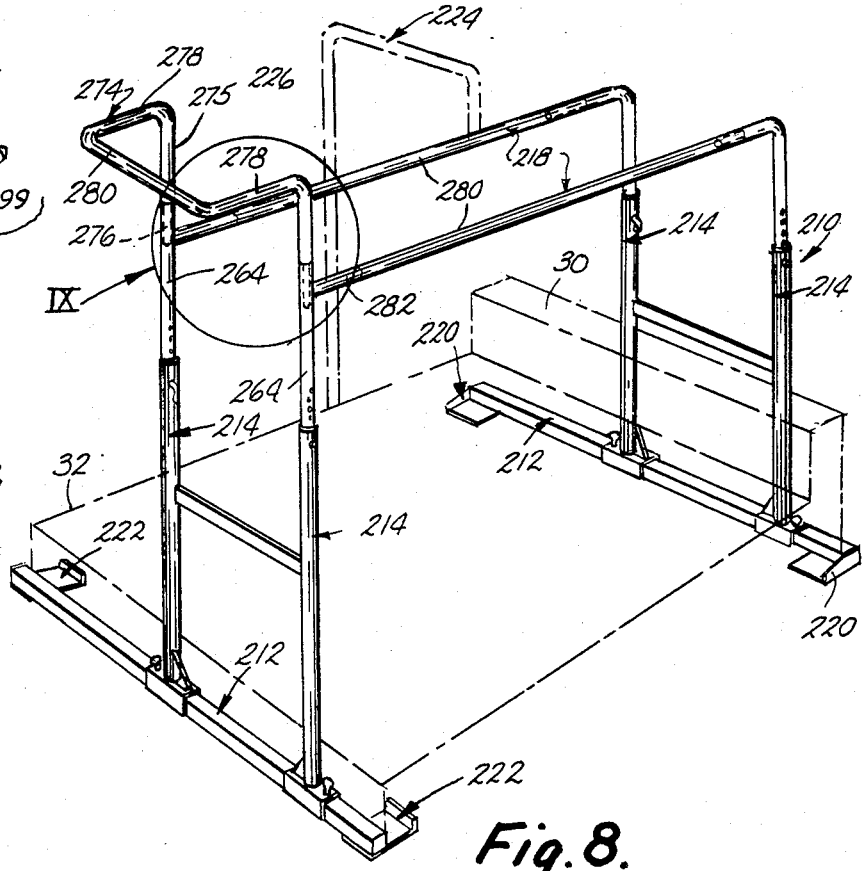
FIG. 8 is a perspective view of an apparatus forming a second embodiment of the invention.

The apparatus 210 shown in FIGS. 8 and 9 is identical to apparatus 10 described above, with the exception of the features noted below. Similar elements have therefore been given complementary reference numerals with a 200 prefix. Apparatus 210 therefore includes floor runners 212, uprights 214, overhead bars 218, anchor plates 220 and 222, outrigger bar 224 and support posts 226.

As shown in FIG. 8, apparatus 210 includes an end access assembly that is located at the foot end 32 of bed 16. Upright upper sections 264 extend upwardly past overhead bars 218. An end access bar assembly 274 is telescopingly received in the upper ends of upper sections 264. End access assembly 274 includes end height spacer bars 275 which each include a depending post 276 that slides into uprights 264. A pair of end spacing bars 278 extend parallel to overhead bars 218 but opposite thereto in order to project past the end of bed 16. A joining bar 280 connects the outboard end of end spacing bars 278 to provide a handhold therebetween. A patient can thus use joining bar 280 to enter or exit bed 16 at the foot end of the bed.

It will be noted that the structure of apparatus 10 can be converted to the structure of apparatus 210 by replacing a pair of upright upper sections 64 with a pair of upright upper sections 264 having end access assembly 274 mounted thereon.

It is to be understood that the above is merely a description of the preferred embodiments, and that one skilled in the art will recognize that various modifications or improvements may be made without departing from the spirit of the invention disclosed herein. The scope of protection afforded is to be determined by the claims and the breadth of interpretation that the law allows.

The embodiments of the invention in which an exclusive property or privilege is claimed are as follows:

1. A freestanding bed access apparatus for use with a bed having a head, a foot, sides and floor support that support the bed on a supporting floor surface, comprising:

means defining a base for resting on the floor surface and for supporting the bed access apparatus thereon, said base including a head base for locating at the head of a bed and a foot base spaced therefrom for locating at the foot of a bed to accommodate said bed therebetween;

a generally vertical upright extending upwardly from said head base and a generally vertical upright extending upwardly from said foot base;

at least one overhead bar spanning between said uprights to extend over a bed located between said head base and said foot base; and a head anchor plate secured to said head base and a foot anchor plate secured to said foot base, said head anchor plate and said foot anchor plate disposed to rest on the floor surface supporting a bed, said head anchor plate and said foot anchor plate having a size and spacing therebetween to accommodate floor supports of a bed thereon, whereby said bed access apparatus is stabilized by the bed resting thereon, such that additional securance to the bed frame is not required.

2. The bed access apparatus of claim 1, further comprising:

means for adjusting the spacing between said head anchor plate and said foot anchor plate so as to accommodate beds of different sizes therebetween.

3. The bed access apparatus of claim 2, further comprising:

at least two of said head anchor plates and at least two of said foot anchor plates; and means for adjusting the spacing between said head anchor plates and between said foot anchor plates so as to accommodate beds of different sizes.

4. The bed access apparatus of claim 3, further comprising an outrigger bar coupled to said overhead bar and extending generally laterally thereto; and an upright outrigger support post connected to said outrigger bar and spaced from said overhead bar for resting on the floor to support said outrigger bar and weight placed thereon.

5. The bed access apparatus of claim 4, wherein:

said outrigger bar is vertically spaced above said overhead bar.

6. The bed access apparatus of claim 5, wherein:

said head base comprises a head floor runner with said head anchor plate secured thereto and said foot base comprises a foot floor runner with said foot anchor plate secured thereto;

two of said uprights being secured to said head floor runner to be adjustably positionable along the length thereof, and two of said uprights being secured to said foot floor runner to be adjustably positionable along the length thereof; and a pair of said overhead bars one spanning between said two uprights at said head runner, and one spanning between said two uprights at said foot runner.

7. The bed access apparatus of claim 6, wherein:

said outrigger bar is coupled to both said overhead bars.

8. The bed access apparatus of claim 6, further comprising:

a pair of end spacing bars extending from said uprights at one of said head base and said foot base, said end spacing bars extending away from said overhead bars and away from a bed positioned within said apparatus; and a joining bar secured between said end spacing bars.

9. The bed access apparatus of claim 6, wherein:

said outrigger bar and said outrigger support post is a first generally flat module selectively removable from said overhead bar, and said overhead bars are a second set of generally flat modules selectively removable from said uprights, so that said uprights and each said head and foot base form a third and a fourth generally flat module, whereby said bed access apparatus selectively breaks down to generally flat modules for transportation and storage.

10. The bed access apparatus of claim 1, further comprising:

at least two of said head anchor plates and at least two of said foot anchor plates; and means for adjusting the spacing between said head anchor plates and between said foot anchor plates so as to accommodate beds of different sizes.

11. The bed access apparatus of claim 1, further comprising:

an outrigger bar coupled to said overhead bar and extending generally laterally thereto, and said outrigger bar being vertically spaced above said overhead bar; and an upright outrigger support post connected to said outrigger bar and spaced from said overhead bar for resting on the floor to support said outrigger bar and weight placed thereon.

12. The bed access apparatus of claim 1, further comprising:

a pair of said uprights at one of said head base and said foot base;

a pair of end spacing bars extending from said pair of uprights so as to extend away from said overhead bar and from a bed positioned within said apparatus; and a joining bar secured between said end spacing bars.

13. A freestanding bed access apparatus for use with a bed having a head, a foot, sides and floor supports that support the bed on a supporting floor surface, comprising:

means defining a base for resting on the floor surface and for supporting said bed access apparatus thereon, said base comprising a head base and a foot base;

a generally vertical head upright secured at said head base;

a generally vertical foot upright secured at said foot base;

an overhead bar extending between said head upright and said foot upright;

a height spacing bar coupled to said overhead bar; and an outrigger bar coupled to said overhead bar by said height spacing bar, such that said outrigger bar is spaced above said overhead bar and extends generally laterally to said overhead bar.

14. The bed access apparatus of claim 13, further comprising:

an outrigger support post secured to said outrigger bar, said outrigger support post having a base resting on the supporting floor surface.

15. The bed access apparatus of claim 14, wherein:

said head upright, said foot upright and said outtrigger support post are selectively height adjustable.

16. The bed access apparatus of claim 15, further comprising:

at least two anchor plates secured to said base, one at said head base and one at said foot base; and said anchor plates resting an the supporting floor surface and said anchor plates having a size and spacing sufficient to support floor supports of a bed thereon.

17. The bed access apparatus of claim 16, further comprising:

at least two of said head uprights, at least two of said foot uprights and at least two of said overhead bars, said overhead bars extending between complementary ones of said head uprights and said foot uprights, and said outrigger bar being coupled to both said overhead bars.

18. The bed access apparatus of claim 17, wherein:

said head base includes a head floor runner and said foot base includes a foot floor runner, said uprights being secured to said floor runners so as to be selectively adjustable therealong.

19. The bed access apparatus of claim 13, further comprising:

at least two anchor plates secured to said base, one at said head base and one at said foot base; and said anchor plates resting on the supporting floor surface and said anchor plates having a size and spacing sufficient to support floor supports of a bed thereon.

20. The bed access apparatus of claim 13, wherein:

said head base includes a head floor runner and said foot base includes a foot floor runner, said uprights being secured to said floor runners so as to be selectively adjustable therealong.

21. A freestanding bed access apparatus for use with a bed having floor supports thereon that support the bed on a supporting floor surface, comprising:

a head floor runner and a foot floor runner, said floor runners spaced so as to accommodate a bed therebetween;

a pair of generally vertical head uprights extending upwardly from said head floor runner, and a pair of generally vertical foot uprights extending upwardly from said foot floor runner, said uprights selectively adjustable along said floor runners;

a pair of overhead bars spanning between said uprights so as to extend above a bed located between said floor runners;

a pair of head anchor plates secured to said head floor runner so as to be selectively adjustably positioned thereon, and a pair of foot anchor plates secured to said foot floor runner so as to be selectively, adjustably positioned thereon, said anchor plates having a size and spacing to accommodate the floor supports of a bed thereon;

an outrigger bar coupled to at least one of said overhead bars so as to extend generally laterally to said overhead bars, said outrigger bar spaced above said overhead bars; and an outrigger support post connected to said outrigger bar and spaced from said overhead bars for resting on the floor and supporting said outrigger and weight placed thereon.

* * * * *